US005434279A

United States Patent [19]

Wimmer

[11] Patent Number: 5,434,279

[45] Date of Patent: Jul. 18, 1995

[54] PROCESS FOR PREPARING FATTY ACID ESTERS OF SHORT-CHAIN MONOHYDRIC ALCOHOLS

[76] Inventor: Theodor Wimmer, Frannach 14, A-8081 Heiligenkreuz, Austria

[21] Appl. No.: 232,285

[22] PCT Filed: Nov. 3, 1992

[86] PCT No.: PCT/AT92/00136

§ 371 Date: May 6, 1994

§ 102(e) Date: May 6, 1994

[87] PCT Pub. No.: WO93/09212

PCT Pub. Date: May 13, 1993

[30] Foreign Application Priority Data

Nov. 6, 1991 [AT] Austria ..... 2200/91

[51] Int. Cl.[6] ..... C11C 3/10

[52] U.S. Cl. ..... 554/169; 554/167; 554/168

[58] Field of Search ..... 554/167, 168, 169

[56] References Cited

FOREIGN PATENT DOCUMENTS 0394571 5/1992 Austria .
8300429 9/1984 Brazil .
0127104 12/1984 European Pat. Off. .
0131991 1/1985 European Pat. Off. .
3707563 9/1988 Germany .
9115452 10/1991 WIPO .

OTHER PUBLICATIONS

Lago et al, Oleigineux, vol. 40, #3, 1985, pp. 147–151.
Chemical Abstracts, vol. 102, #8, 1985, 63977.

*Primary Examiner*—José G. Dees
*Assistant Examiner*—Deborah D. Carr
*Attorney, Agent, or Firm*—Herbert L. Lerner; Laurence A. Greenberg; Werner H. Stemer

[57] ABSTRACT

A process is disclosed for preparing fatty acid esters of short-chain monohydric aliphatic alcohols or monoalkylated diols by basically catalyzed esterification of natural, partially or totally synthetic fatty acid glycerides, as well as fatty acid glyceride-based waste products, such as used frying oils. The process is characterized in that the unpurified fatty acid glycerides, containing in particular high proportions of free fatty acids and phosphatides, (a) are esterified in one or several steps in the presence of a basic catalyst with an excess of short-chain alcohol or monoalkylated diol; (b) the glycerin phase produced after the first esterification step is at least partially added to the second or following step, after sterification has been carried out, and the mixture is stirred; (c) the glycerin phase is again separated, the supernatant fatty acid ester is cleared of excess alcohol or diol, then treated with a possibly diluted organic or anorganic acid, and if necessary filtered. This process, that is carried out without pressure and heat supply, is characterized by a technically simple implementation by means of simple equipment, and by a high degree of purity of the thus obtained fatty acid esters.

17 Claims, No Drawings

PROCESS FOR PREPARING FATTY ACID ESTERS OF SHORT-CHAIN MONOHYDRIC ALCOHOLS

This application is the national stage of PCT/AT 72/00156 filed 3 November 1992.

BACKGROUND OF THE INVENTION

FIELD OF THE INVENTION

The present invention relates to a process for preparing fatty acid esters and/or mixtures of fatty acid esters of short-chained monohydric alcohols or monoalkylated diols by trans-esterification of fatty acid glycerides with the short-chained alcohols or monoalkylated diols in the presence of basic catalysts.

The fatty acid esters prepared according to the invention are suitable, depending on the starting materials used, as pharmaceutical, dietetic or cosmetic raw materials, as intermediate products for further fatty acid derivatives, such as fatty alcohols, fatty amines, surfactants and so forth, and also as lubricants, plasticizers, hydraulic oils, fuels, and Diesel fuels.

Because of their suitability as Diesel fuel, such fatty acid esters have recently gained remarkable significance, for reasons of environmental protection, replacement of fossil fuels with renewable energy sources, and in connection with problems that arise in agriculture.

The preparation of fatty acid esters by basically catalyzed trans-esterification has long been known. A survey of known processes may be found in J.A.O.C. Soc. 61 (1984), page 343ff., and in Ullmann, Enzyklopädie d. techno Chemie [Ullmann's Encyclopedia of Chemical Engineering], Fourth Edition, Vol. 11, page 432. In all these processes, the preparation is done by mixing fatty acid glycerides, and in particular animal or vegetable oils and fats, with an excess of the short-chain alcohols, with the addition of a basic catalyst and separation of the subsequently forming heavier glycerine phase, under reaction conditions that very depending on the quality of the starting materials.

The substantial disadvantages of the known processes are that the fatty acid glycerides, if the trans-esterification is to be done at temperatures below 100° C. and without pressure, have to be cleaned after their recovery, for instance by pressing or extraction, and in particular must be freed of free fatty acids and phosphatides. If by comparison uncleaned fatty acid glycerides are used, then high pressures and high temperatures, or other provisions such as pre-esterification of the free fatty acids, alcohol vapor countercurrent processes, etc., must be employed. All these provisions require major engineering and equipment expense and hence high investment costs and make it difficult or impossible to employ these processes for recovering renewable and environmentally friendly energy sources in small systems, for instance in the context of agricultural operations or in developing countries.

Other disadvantages or difficulties in the known processes arise in the phase separation between the lighter fatty acid ester phase and the heavier glycerine phase, which is done either very slowly or, because of emulsification, incompletely or not at all; this applies above all to raw, hot-pressed or extracted vegetables oils with a high phosphatide content.

Separating the components of the basic catalyst that remain in the fatty acid ester phase presents another difficulty. If this separation is done by washing with water or with dilute acids, then emulsification, especially if phosphatide-rich oils are used, and the major production of waste water present problems. If ion exchangers are used, then their regeneration and the waste water produced also present problems.

The need therefore exists for a process that at minimal engineering and equipment expense furnishes fatty acid esters of high purity, as required for instance for use as Diesel fuel, by using raw uncleaned vegetable or animal oils and fats, in particular those with a high content of free fatty acids and phosphatides, with fast, complete separation of the glycerine phase and with simple removal of the catalyst residues.

SUMMARY OF THE INVENTION

This object is attained in accordance with the invention in that a) the trans-esterification is carried out in the presence of from 0.5% to 5.0%, referred to the mass of the fatty acid glyceride used, of a basic catalyst, in an excess of the short-chain alcohol or monoalkylated diol of from 1.1 to 3.0 mol per mol of glycerine-bound fatty acid, optionally in the presence of from 0.5% to 10% water, referred to the mass of the fatty acid glyceride used;

b) that the glycerine phase obtained by settling and separation after trans-esterification has been done in the first step is added either entirely or in part, but at least up to an amount of one-tenth, after the trans-esterification of the second step or of a further step, to this step while stirring, and c) that after renewed settling and separation of the heavy glycerine phase and after removal of excess short-chain alcohol or monoalkylated diol, an optionally diluted organic or inorganic acid is added while stirring, and after phase separation has been done the fatty acid ester phase is removed and optionally filtered.

Fatty acid esters produced in this way, without further treatment, meet all the requirements for purity made of Diesel fuels.

As the catalysts, basic alkaline or alkaline earth metal compounds, such as the oxides, hydroxides, alcoholates, borates, carbonates, aluminates or silicates of lithium, sodium, potassium or calcium, as concentrated aqueous or alcohol solution, can be considered.

As short-chained alcohols, monohydric aliphatic alcohols having from 1 to 5 carbon atoms, such as methanol, ethanol, butanols, fermentation amylalcohol, neopentyl alcohol or fusel oils, and aliphatic diols having from 2 to 5 carbon atoms, which are monoalkylated by alkyl radicals having from 1 to 3 carbon atoms, such as ethylene glycol monomethyl ether, 1,2-propane diol monomethyl ether or ethylene glycol monoisopropyl ether, can be considered. The alcohols or monoalkylated diols mentioned may be used either pure or in arbitrary mixture proportions with one another.

As the fatty acid glycerides, all naturally occurring vegetable and animal fats and oils, all partly or fully synthetic fatty acid glycerides and used fatty acid glycerides, such as used frying oils and fats, as well as used industrial fats and oils based on glyceride, such as soybean oil, sunflower oil, linseed oil, rapeseed oil, castor oil, palm oil, palm kernel oil, coconut oil, cottonseed oil, peanut oil, olive oil, beef tallow, used frying oil or grease, used hydraulic or lubricating oils, can be considered. These oils may be used in the raw state from hot or cold pressing or from an extraction with up to 20% free fatty acids and up to 3% phosphatides, or in an arbitrarily purified form. They can be present alone or in arbitrary mixture proportions with one another.

By way of example, as the organic or inorganic acids, phosphoric, sulfuric, hydrochloric, nitric, boric, formic, acetic, lactic, gluconic, oxalic, succinic, maleic, tartaric, malic and citric acid, as well as organic sulfonic acids and sulfuric acid semiesters and concentrated solutions of acidic salts, such as potassium or sodium hydrogen sulfate, potassium or sodium dihydrogen phosphate, or monopotassium and monosodium hydrogen citrate, can be considered.

The acids can be used in concentrated or semi-concentrated form. Even 10% to 20% acid solutions can be used.

The trans-esterification by the process of the invention is done in such a way that the fatty acid glyceride is placed beforehand in a container; that in a first step, four-tenths to ten-tenths of the total quantity of short-chain alcohol or monoalkylated diol used and four-tenths to nine-tenths of the total quantity of the catalyst used, in concentrated aqueous or alcoholic solution, is added while stirring, and this composition is stirred for from 5 to 60 minutes. After phase separation has been done by gravity, the heavier glycerine phase is drained out through an opening located on the bottom of the container, and the remainder, in a second or in further steps, is mixed while stirring with the remaining quantity or quantities of the short-chain alcohol or monoalkylated diol or a further additive thereof and with the remaining quantity or quantities of the basic catalyst and stirred for from 5 to 60 minutes. Next, the glycerine phase previously drained out is added in entirety or partially, but at least up to one-tenth, and this composition is stirred for from 2 to 10 minutes. If the process has more than two steps, then the glycerine phase from the previous step is added to the next step after its trans-esterification. Once phase separation has been done, the glycerine phase is drained out again, and the remaining fatty acid ester is freed in a known manner of excess alcohol or diol by distillative or adsorptive methods, and optionally after settling and separation of a further quantity of a heavier phase, an optionally diluted organic or inorganic acid is added, and this composition is stirred for from 10 to 60 minutes. The quantity of acid required is very low. It depends on the quantity of basic catalyst remaining in the fatty acid ester, and it ranges from 0.02 to 0.1 weight %, referred to the quantity of the fatty acid ester. Preferably, the acid is added in a quantity of from 1% to 10%, whereupon the composition is stirred. Once phase separation has been done, the acid phase is re-used for the next starting batch, until its capacity is exhausted, or in other words the acid is virtually neutralized. Once phase separation has been done, the remaining fatty acid ester is removed and, optionally, filtered, preferably by means of a coalescence filter.

By the process of the invention, the same short-chain alcohol or the same monoalkylated diol, or a certain mixture ratio thereof, and the same catalyst are preferably used in all the trans-esterification steps. It is also possible, however, to use one of the alcohols mentioned or a diol in the first step, and to use another of the alcohols mentioned or another diol in the other steps. It is also possible to use one of the catalysts mentioned in the first step and another one of the those catalysts in the second step.

The trans-esterification by the process of the invention is done at atmospheric pressure and temperatures between −25° C. and +60° C., if the viscosity or solidification point of the fatty acid glyceride permits this. It may possibly be necessary for fatty acid glycerides, which are in solid form at the ambient temperature, to be converted to liquid phase by heating.

The preparation of the fatty acid esters by the process of the invention can be done in open or closed vessels of arbitrary size, which are preferably equipped with a drain device on the bottom. With batch sizes of up to 2000 l, the stirring can be done by hand, by means of a simple electrically or compressed-air-operated paddle agitator, or preferably in closed containers with a permanently mounted agitator mechanism. The separation of the phases is done by the action of gravity. The removal of excess alcohol or monoalkylated diol is done in a known manner, for instance by means of a falling-film evaporator, or bubbling air, nitrogen or water vapor through it. The required manipulation can be done by hand or automated arbitrarily. If suitable metering devices, a special reaction vessel and a suitable monitoring system are present, then the process according to the invention can also be carried out continuously.

The process is distinguished by the following substantial advantages:

- very fast, exact separation of the phases even at high phosphatide contents;
- high degree of purity of the fatty acid esters;
- minimal engineering and equipment expense;
- trans-esterification at ambient temperatures and atmospheric pressure;
- the capability of using raw oils and fats, particularly those with a high content of phosphatides;
- the capability of using commercially available concentrated aqueous sodium or potassium hydroxide solution, thus making it unnecessary to prepare the catalyst solution.

The invention will be described below in terms of the following examples:

EXAMPLE 1

100 g of hot-pressed rapeseed oil with 1.4% free fatty acids and 1.5% phosphatides are placed beforehand in a beaker; 20 ml of methanol in which 1.0 g of potassium hydroxide are dissolved are added, and the composition is stirred by a magnetic agitator at approximately 20° C. for 40 minutes. No later than after standing for 1 h, two exactly separated phases have formed. After transfer to a separator funnel, 17 g of the heavier glycerine phase can be separated off. The remaining fatty acid ester is transferred back into the beaker, 0.9 ml of methanol in which 0.3 g of potassium hydroxide are dissolved are added, and the composition is stirred for 45 minutes. After that time, 15 g of the previously separated-off glycerine phase are added, and this composition is stirred for a further 2 minutes. No later than after standing for 1 h, the glycerine phase is separated off again. The quantity amounts to 16.5 g. The remainder is then freed of excess methanol in a rotation evaporator and then stirred for 30 minutes with 5 g of a 60% aqueous citric acid solution. The phase separation is ended after 10 minutes. The remaining fatty acid ester, for complete separation off of the acid phase, is filtered via a paper filter.

The yield of rapeseed methyl ester is 95 g.

Non-trans-esterified fatty acid glycerides: 0.9%

Free glycerine: 0.02%
Total glycerine: 0.15%
Sulfate ash: 0.01%
Conradson carbon (coking) residue: 0.04%

EXAMPLE 2

100 g of used frying grease from restaurant operation, with 0.8% free fatty acids, is heated to approximately 40° C., mixed with 20 ml of methanol that contains 1.0 g of potassium hydroxide, and the procedure is continued precisely as in Example 1.
The yield is 91 g.
Free glycerine: 0.005%
Total glycerine: 0.25%
Sulfate ash: 0.01%
Conradson carbon residue: 0.05%

EXAMPLE 3

100 g of cold-pressed rapeseed oil with 0.6% free fatty acids and 0.02% phosphatides is placed beforehand in a beaker. 22 ml of methanol and 3.0 g of a 47% aqueous potassium hydroxide solution are added, and this composition is stirred with a magnetic agitator for 60 minutes. After standing for 2 h, the glycerine phase is separated off. A further 0.65 g of 47% potassium hydroxide solution are added to the remainder and this composition is stirred for 60 minutes; next, 8 g of glycerine phase from the first step are added, this composition is stirred for a further 2 minutes, and after settling for 2 h the glycerine phase is separated off. After removal of the excess methanol in the rotation evaporator, 5 ml of 85% phosphoric acid are added, and this composition is stirred for 5 minutes. After 1 h, the phases are separated, and the remaining rapeseed methyl ester is filtered via a paper filter.
Yield: 93 g
Total glycerine: 0.24%
Sulfate ash: 0.015%
Conradson carbon residue: 0.02%

I claim:

1. In a process for preparing fatty acid esters and mixtures of fatty acid esters of short-chain monohydric alcohols having from 1 to 5 carbon atoms or short-chain diols having from 2 to 5 carbon atoms, which are monoalkylated by alkyl radicals having from 1 to 3 carbon atoms, by trans-esterification of fatty acid glycerides with the alcohols or monoalkylated diols in the presence of a basic catalyst, in a plurality of steps, the improvement which comprises:

a) carrying out a trans-esterification in the presence of from 0.5% to 5.0% of a basic catalyst, based on the amount of fatty acid glyceride, and in the presence of a short-chain alcohol or monoalkylated diol in an excess over a stoichiometric quantity of from 10% to 200% per mol of glycerine-bound fatty acid; and obtaining a relatively lighter fatty acid ester phase and a relatively heavier glycerine phase by settling and separating;

b) subjecting the relatively higher fatty acid ester phase obtained in step a) to transesterification in the presence of a basic catalyst and a short-chain alcohol or a monoalkylated diol;

c) adding at least one-tenth of the relatively heavier glycerine phase obtained in step a), while stirring; and obtaining a fatty acid ester phase and a heavy glycerine phase by settling and separating;

d) removing excess short-chain alcohol or monoalkylated diol from the fatty acid ester phase obtained in step c, subsequently stirring in acid and, after a completed phase separation, removing the fatty acid ester phase.

2. The process according to claim 1, which further comprises filtering the fatty acid ester phase in the removing step.

3. The process according to claim 1, which further comprises introducing the acid in one of concentrated and semiconcentrated form in step d).

4. The process according to claim 1, which further comprises carrying out the trans-esterification of step a) in the presence of from 0.5% to 10% water based on the mass of the fatty acid glyceride used.

5. The process according to claim 1, which further comprises carrying out the trans-esterification in a temperature range between −25° C. and +60° C. and at atmospheric pressure.

6. The process according to claim 1, which further comprises introducing from four-tenths to ten-tenths of a total quantity of short-chain alcohol or monoalkylated diol in step a), and introducing from zero to six-tenths of the total quantity in a subsequent step.

7. The process according to claim 1, which further comprises introducing from four-tenths to nine-tenths of a total quantity of basic catalyst in step a), and introducing from one-tenth to six-tenths of the total quantity in a subsequent step.

8. The process according to claim 1, which further comprises introducing the same short-chain alcohol or the same monoalkylated diol and the same basic catalyst throughout all trans-esterification steps.

9. The process according to claim 1, which further comprises introducing a given basic catalyst, a given alcohol, a given monoalkylated diol, or a given mixture ratio of alcohols or diols in the first trans-esterification step, and introducing a basic catalyst different from the give basic catalyst, an alcohol or diol different from the given alcohol or diol, respectively, or a different mixture ratio of the alcohols and diols in a subsequent trans-esterification step.

10. The process according to claim 1, which further comprises carrying out the trans-esterification with monohydric aliphatic alcohols having from 1 to 5 carbon atoms, and aliphatic diols having from 2 to 5 carbon atoms and being monoalkylated by alkyl radicals having from 1 to 3 carbon atoms.

11. The process according to claim 9, which further comprises selecting the monohydric aliphatic alcohols from the group consisting of methanol, ethanol, butanols, fermentation amylalcohol, neopentyl alcohol and fusel oils, and selecting the aliphatic diols from the group consisting of ethylene glycol monomethyl ether, 1,2-propane diol monomethyl ether, ethylene glycol monoisopropyl ether, and mixtures thereof.

12. The process according to claim 1, which further comprises carrying out the trans-esterification steps with catalysts selected from the group consisting of basic alkaline and alkaline earth metal compounds.

13. The process according to claim 11, which further comprises selecting the basic catalyst from the group consisting of oxides, hydroxides, alcoholates, borates, carbonates, aluminates and silicates of lithium, sodium, potassium and calcium, in one of concentrated aqueous and alcohol solution.

14. The process according to claim 1, which further comprises carrying out a transesterification with fatty acid glycerides selected from the group consisting of naturally occurring vegetable and animal fats and oils, partly or fully synthetic fatty acid glycerides and used fatty acid glycerides; used industrial fats and oils based on glyceride, in raw, uncleaned or arbitrarily cleaned quality, with contents of free fatty acids of up to 20% or phosphatide contents of up to 3%, and mixtures thereof.

15. The process according to claim 13, which further comprises carrying out the transesterification with fatty acid glycerides selected from the group consisting of used frying oils and fats; soybean oil, sunflower oil, linseed oil, rapeseed oil, castor oil, palm oil, palm kernel oil, coconut oil, cottonseed oil, peanut oil, olive oil, beef tallow, used frying oil; used hydraulic oil and lubricating oil.

16. The process according to claim 1, which further comprises stirring in the acid in step d) in the form of an acid selected from the group consisting of phosphoric, sulfuric, hydrochloric, nitric, boric, formic, acetic, lactic, gluconic, oxalic, succinic, maleic, tartaric, malic and citric acid; organic sulfonic acids and sulfuric acid semiesters and concentrated solutions of acidic salts.

17. The process according to claim 1, which further comprises adding an acidic salt from the group consisting of potassium and sodium hydrogen sulfate, potassium and sodium dihydrogen phosphate, and monopotassium and monosodium hydrogen citrate, in step d).

* * * * *